United States Patent [19]

Bessinger

[11] Patent Number: 4,720,069

[45] Date of Patent: Jan. 19, 1988

[54] LOCK PIN CANTILEVER SHELF

[75] Inventor: Walter L. Bessinger, Grand Haven, Mich.

[73] Assignee: Knape & Vogt Manufacturing Co., Grand Rapids, Mich.

[21] Appl. No.: 898,419

[22] Filed: Aug. 21, 1986

[51] Int. Cl.[4] ..... A47G 29/02

[52] U.S. Cl. ..... 248/250; 211/90

[58] Field of Search ..... 248/250, 235, 225.1, 248/225.2, 223.4; 108/152, 108; 211/90

[56] References Cited

U.S. PATENT DOCUMENTS

| | | | |
|---|---|---|---|
| 569,640 | 10/1986 | Hartzell | 248/250 X |
| 2,747,745 | 5/1956 | Sontheim | 211/90 |
| 3,421,458 | 1/1969 | Salkoff et al. | 108/152 X |
| 3,437,214 | 4/1969 | Sainsbury | 211/90 |
| 4,361,099 | 11/1982 | Kokenge | 248/250 X |
| 4,385,565 | 5/1983 | Roberts | 108/152 |
| 4,407,476 | 10/1983 | Bohannan | 108/152 X |
| 4,508,301 | 4/1985 | Nicholson | 108/152 X |
| 4,603,781 | 8/1986 | Ryan | 211/90 |

*Primary Examiner*—J. Franklin Foss

*Attorney, Agent, or Firm*—Price, Heneveld, Cooper, DeWitt & Litton

[57] ABSTRACT

A shelf bracket assembly that includes a shelf bracket and a wall bracket. The shelf bracket is mountable to the bottom of a shelf, and has downwardly depending and rearwardly extending tapered members that are received by recesses in the wall bracket and are engaged with like tapered surfaces in said recess for slidably rearwardly engaging said brackets. Adjacent the interengaged components are locking pin receiving spaces. Locking pins are shown attached to end panels. Insertion of the pins locks the brackets together and retains the end panels in place.

14 Claims, 3 Drawing Figures

LOCK PIN CANTILEVER SHELF

BACKGROUND OF THE INVENTION

This invention relates to a cantilever shelf bracket assembly.

Cantilever shelf brackets of various types have been known for many decades. In recent years, public interest has been shown in elongated cantilever shelf brackets of extruded construction, as of aluminum. Examples of such brackets are set forth in U.S. Pat. Nos. 4,508,301 and 4,385,565. Such brackets enable a shelf of predetermined thickness to be lockingly engageable into a bracket recess so as to be tightly sandwiched between an underlying support and an overlying support. While such arrangements are effective, it is sometimes desirable to be able to accommodate shelves of widely varying thicknesses. Moreover, it is sometimes desirable or necessary to have usable shelf space that extends from the front edge of the shelf clear to the wall on which the shelving is mounted.

SUMMARY OF THE INVENTION

The present invention provides a cantilevered shelf assembly capable of accommodating a shelf of any desired thickness, with no specific thickness limitation necessary to assemble the apparatus. The support mechanism is completely beneath the shelf, accommodating various shelving thicknesses. Moreover, the top of the shelf has usable clearance all the way from the front edge to the wall surface, i.e., for the full depth of the shelf.

The bracket assembly of this invention is composed of two special interfitting brackets, one being a shelf bracket to be mounted to a shelf and the other being a wall bracket to be mounted to the wall. These are interlockable with a sliding interfit capable of being rapidly interconnected or disconnected as desired, yet safely mounted against accidental disconnection. The components are interlocked with a transverse locking mechanism shown to be locking pins which are inserted between the brackets.

Both brackets are extruded as from aluminum, and are capable of coextrusion so as to minimize expense of manufacture.

These and other objects, advantages and features of the invention will become apparent upon studying the following specification in conjunction with the drawings.

DESCRIPTION OF THE PREFERRED EMBODIMENTS

Figure 1:
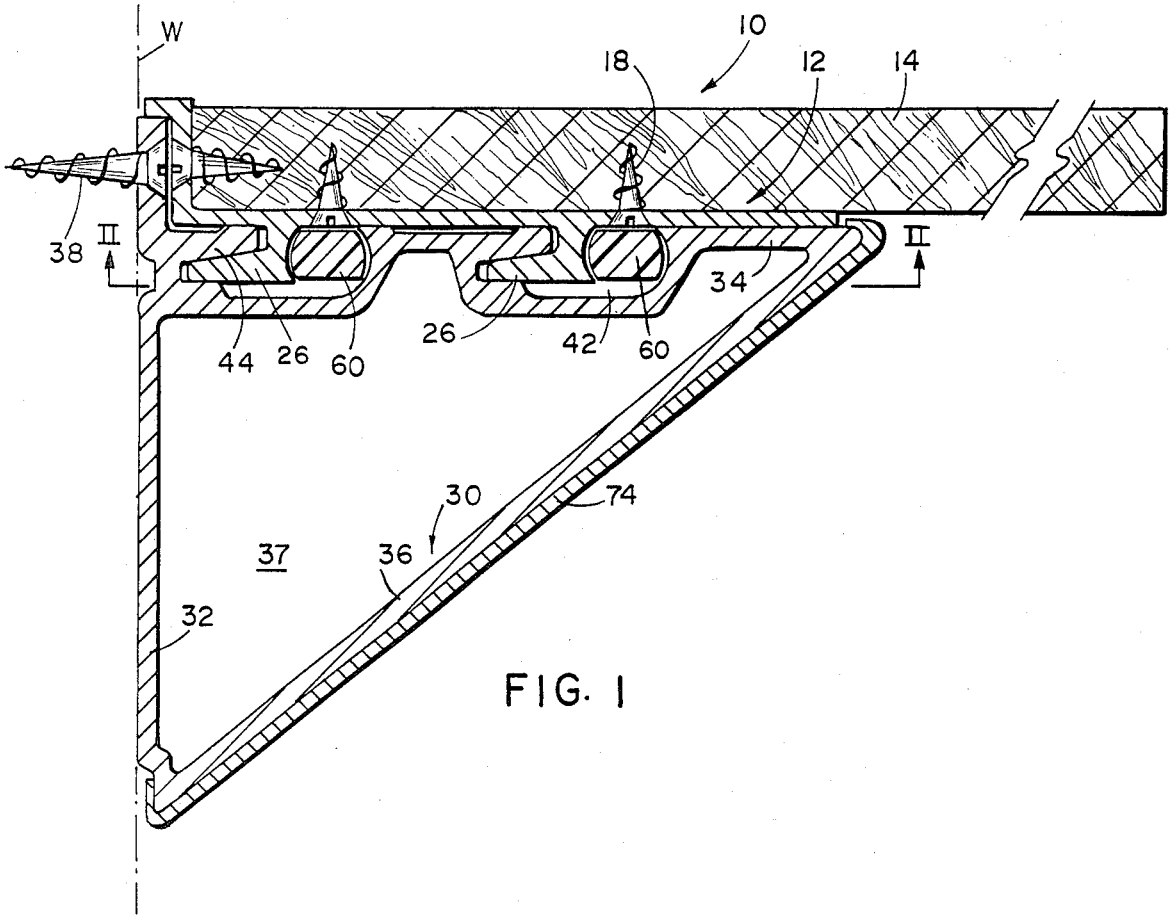
FIG. 1 is a sectional side elevational view of the novel bracket assembly, with a shelf in place.

Referring now specifically to the drawings, the bracket and shelf assembly 10 depicted in FIG. 1 includes the novel bracket assembly 12 shown mounting a shelf 14 and adjacent a wall W.

The shelf may be of any conventional material, typically wood or the like, capable of being secured to the shelf bracket 16 (FIG. 3) as by fasteners, e.g. screws 18, and/or adhesive, or otherwise.

Figure 2:
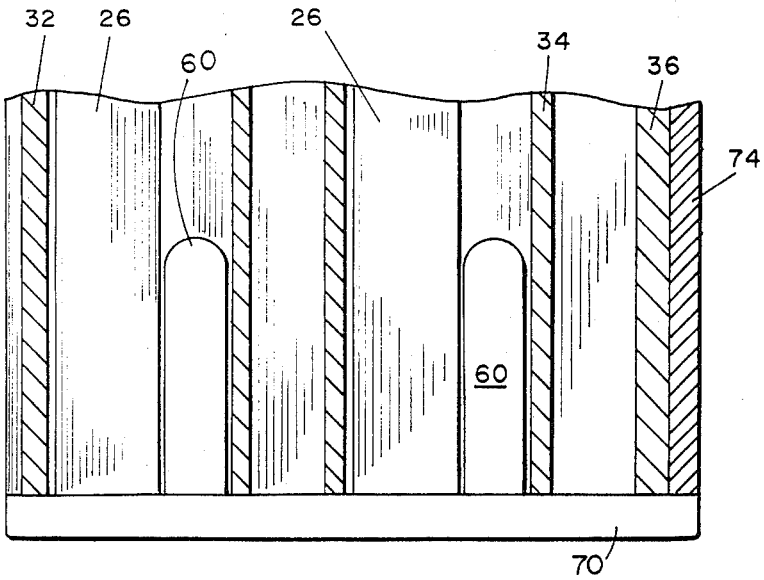
FIG 2 is a fragmentary plan view of a portion of the assembly in FIG. 1.
Figure 3:
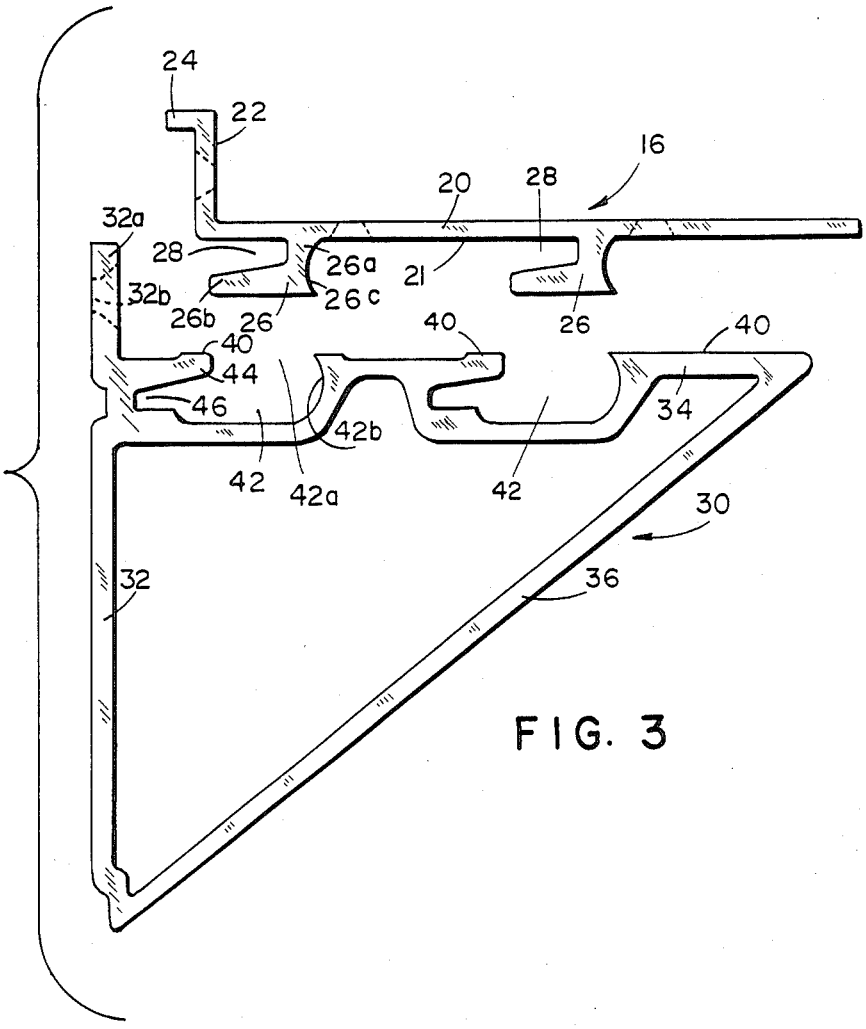
FIG. 3 is an elevational view of the two bracket components in unassembled condition.

Shelf bracket 16 comprises an elongated member for underlying the shelf, preferably being of extruded aluminum or equivalent material. It includes a horizontally oriented planar portion 20, preferably an integral upstanding rear flange 22 for engaging the rear edge of shelf 14, and optionally a stop and support flange 24 extending rearwardly from the upper edge of flange 22 for engaging the upper edge of the wall bracket 30 (FIG. 3). Flange 24 also extends the horizontal top surface of the shelf 14 to the wall in a neat appearance, which hides all construction details such as stub **32*a* and makes this area easy to clean. Extending downwardly from the lower surface of planar member 20 is at least one, here shown to be two, elongated coupling lugs 26, each having a downwardly extending stem 26*a* and a rearwardly extending convergently tapered foot 26*b*, i.e., generally V-shaped to the rear. If two or more of these are employed, they are arranged in parallel fashion, i.e., extending laterally in the direction of the length of the shelf bracket, and spaced from each other from front-to-rear. Behind each stem 26*a* and above foot 26*b* is a forwardly convergent space 28, i.e., generally V-shaped to the front, for receiving a mating portion on the wall bracket. On the front face of this male connector lug 26 is a configurated face 26*c* for cooperative interfit with a transversely extending, like configurated, locking bar or pin 60 (FIGS. 1 and 2**).

The wall bracket 30 includes an upstanding rear panel 32 with a wall engaging rear surface, a forwardly extending horizontal upper panel 34, and preferably a diagonally downwardly rearwardly extending support and enclosure panel 36 extending from the outer front edge of panel 34 downwardly to the lower edge of vertical panel 32. These three panels enclose a space 37 which can be employed for receiving wiring or the like. Rear panel 32 has a stub portion **32*a* which extends above horizontal panel 34 and contains suitable fastener receiving openings 32*b* (FIG. 3) therein for additional fasteners 38 (FIG. 1) to attach wall bracket 30** to the wall W.

Horizontal panel 34 not only includes an upper surface area 40 formed of successive coplanar portions, for engaging lower surface 21 of shelf bracket panel 20, but also includes transversely elongated groove-type cavities 42. Each has an upwardly open mouth **42*a*. The front-to-rear width of the mouth 42*a* of each such cavity is greater than the front-to-rear width of foot 26*b* depending from the shelf bracket, to allow vertical entry of the foot into the cavity. At the rear of the mouth is a forwardly projecting generally V-shaped tang 44 which has a downwardly rearwardly tapered undersurface for engaging the downwardly and rearwardly, like tapered upper surface of foot 26*b*, thereby enabling foot 26*b*, after vertical insertion down into the female coupler cavity, to be rearwardly slid into snug relationship with this tapered surface. This occurs as the bottom surface 21 of shelf bracket panel 20 engages the portion of upper surface 40 immediately to the rear of the cavity. The male foot 26*b* therefore tightly engages with female recess 46 at the rearward portion of cavity 42, as the forwardly extending tang 44 engages space 28**. Thus, each of the brackets has a male coupler and a female coupler, simultaneously interengaged during assembly.

After the interfitting sliding connection is made between the shelf bracket and the wall bracket, a laterally extending locking pin 60 is inserted into the cavity space between the forward curved face 26c of element 26, and the rearwardly facing but forward configurated surface 42b of the cavity, to prevent removal of the shelf bracket from the wall bracket. These locking pins, shown here to be two in number, are preferably mounted to an end panel 70 (FIG. 2) for the assembly. Thus the end panel covers the end surfaces of the bracket components and space 37 for aesthetic purposes, and serves to insert locking pins 60 in place. The forward noses of the locking pins are preferably tapered for ready insertion. The locking pin insertion in turn retains end panel 70 in place. In FIGS. 1 and 2, pins 60 are shown with a clearance or space between them and the adjacent surfaces. This is merely for clarity of illustration. In actual practice, pins 60 have a snug sliding relationship with surfaces 26c and 42b to retain the brackets tightly together and to hold the pins and therefore the end panels firmly. Although only one end panel and set of locking pins is shown, there usually will be two, one for each end, in mirror image. These locking pins may be provided with a slight taper for frictional retention. If desired, the end panels can be further secured to the brackets with additional fasteners.

If desired, the downwardly rearwardly extending front panel 36 of wall bracket 30 may be covered by a suitable dress strip 74 (FIG. 1), e.g., of anodized aluminum, polymeric material or the like, such dress strip having curled upper and lower edges for being resiliently snapped over the upper forward and downward rearward apices of the junctures of panels 34, 36 and 32.

It is conceivable that the invention taught herein and shown by the illustrative preferred embodiment in FIGS. 1–3 may be modified in certain respects to accommodate particular situations. Therefore, it is intended that the invention is to be limited only by the scope of the appended claims and the reasonably equivalent structures to those defined therein, and not by the illustrative embodiment set forth.

The embodiments of the invention in which an exclusive property or privilege is claimed are defined as follows.

1. A shelf bracket assembly comprising:

a wall bracket; said wall bracket having a vertical wall engaging surface and a horizontally extending support portion;

a first coupler at said support portion including a female or a male member;

a shelf bracket; said shelf bracket having a horizontally extending shelf support portion having at the bottom thereof a male or a female member for respectively interengaging with said female or male member on said wall bracket;

said first and second couplers being complementary to each other to interfit with each other in a sliding interfit when said shelf bracket is moved downwardly and rearwardly relative to said wall bracket;

said first and second couplers, when interfitted, defining a receiving space therebetween; and interlock means in said space between said first and second couplers to prevent removal of said shelf bracket and any shelf thereon from said wall bracket.

2. The shelf bracket assembly in claim 1 wherein:

said first coupler on said wall bracket includes a transversely elongated female cavity;

said second coupler on said shelf bracket includes a downardly and rearwardly extending male member; and said cavity and said male member having cooperatively tapered surfaces for a snug interfit.

3. The shelf bracket assembly in claim 2 wherein:

said cavity includes said receiving space forwardly of said male member when said first coupler is interconnected with said second coupler, and said interlock means comprises a transversely extending locking pin in said receiving space for retaining said shelf bracket engaged with said wall bracket.

4. The shelf bracket assembly in claim 3 including:

end panels, and said end panels having said locking pins extending therefrom.

5. The shelf bracket assembly in claim 2 wherein:

said recess includes an upper receiving mouth having a front-to-rear dimension greater than the front-to-rear dimension of said male member, to enable said male member to be vertically inserted down into said recess through said mouth, followed by rearward movement of said shelf bracket and male member for completing said sliding interfit.

6. A shelf bracket assembly comprising:

a wall bracket; said wall bracket having a vertical wall engaging surface and having a horizontally extending top portion;

said top portion including at least one transversely elongated recess having an upwardly opening mouth and a rearwardly facing front wall;

said recess also having a rearwardly extending slot with a tapered surface, and an overlying lug over said slot defining one edge of said mouth;

a shelf bracket for attachment to the bottom of a shelf and including a bottom portion; said bottom portion including at least one downwardly depending and rearwardly extending connector element having a rearwardly extending tapered surface cooperative with said tapered surface of said slot in said wall bracket recess to interfit therewith;

said depending member having a front-to-rear width less than the front-to-rear width of said recess mouth to enable vertical insertion of said depending member into said recess through said mouth;

said depending element having a front face;

said shelf bracket and said wall bracket, when interfitted, defining a transversely extending space between said front wall of said recess and said front face of said element; and locking insert means in said space to prevent detachment of said shelf bracket from said wall bracket.

7. The shelf bracket assembly in claim 6 wherein said locking insert means comprises at least one transverse locking pin.

8. The shelf bracket assembly in claim 6 including end panels, and said locking insert means being on said end panels.

9. The shelf bracket assembly in claim 8 wherein said locking insert means comprise at least one pin extending transversely from said end panels for locking insertion with placement of said end panels.

10. A shelf bracket assembly comprising:

a wall bracket having a wall engaging surface and a horizontally extending support panel; said panel having at least one upwardly opening recess;

a shelf bracket having a horizontally extending shelf support panel; said shelf bracket having at least one depending lug for insertion into said recess;

said recess and lug having interfitting generally V-shaped couplers; and locking means between said brackets for retaining said couplers in interfitted relationship.

11. A shelf bracket assembly comprising:

a wall bracket; said wall bracket having a vertical wall engaging surface and a horizontally extending support portion;

a first coupler on said wall bracket;

a shelf bracket for attachment to a shelf and cooperable with said wall bracket;

a second coupler on said shelf bracket; and interlocking means between said first and second couplers for interlocking said shelf bracket with said wall bracket against removal of said shelf bracket from said wall bracket.

12. The shelf bracket assembly in claim 11 wherein said brackets define a receiving space therebetween and said interlocking means comprise at least one insertable locking element extending into said receiving space to engage said wall bracket and said shelf bracket.

13. The shelf bracket assembly in claim 12 wherein said locking element is elongated and is insertable in the direction of the length of said shelf bracket.

14. The shelf bracket assembly in claim 13 including end caps and wherein said locking element is at least one rod extending from each said end cap.

* * * * *